US007913334B2

(12) United States Patent
Guguin et al.

(10) Patent No.: US 7,913,334 B2
(45) Date of Patent: Mar. 29, 2011

(54) BED WITH A LATERAL BARRIER HAVING A TILT FEATURE

(76) Inventors: Pascal Guguin, Brech (FR); Pascal Lemonnier, Locoal Mandon (FR); Frederic Bregson, St Ave (FR)

( * ) Notice: Subject to any disclaimer, the term of this patent is extended or adjusted under 35 U.S.C. 154(b) by 0 days.

(21) Appl. No.: 12/535,878

(22) Filed: Aug. 5, 2009

(65) Prior Publication Data

US 2010/0031441 A1 Feb. 11, 2010

(30) Foreign Application Priority Data

Aug. 5, 2008 (FR) ..... 08 55418

(51) Int. Cl.
*A47C 21/08* (2006.01)

(52) U.S. Cl. ..... 5/430; 5/425; 5/100

(58) Field of Classification Search ..... 5/430, 100, 5/425

See application file for complete search history.

(56) References Cited

U.S. PATENT DOCUMENTS

| | | | | |
|---|---|---|---|---|
| 3,304,116 | A | 2/1967 | Stryker | |
| 4,376,317 | A * | 3/1983 | Johnston | 5/601 |
| 4,409,695 | A * | 10/1983 | Johnston et al. | 5/601 |
| 6,694,557 | B1 * | 2/2004 | Bobey et al. | 5/425 |
| 6,983,496 | B1 * | 1/2006 | Hernandez | 5/425 |
| 2004/0025253 | A1 * | 2/2004 | Heimbrock et al. | 5/425 |
| 2005/0150044 | A1 | 7/2005 | Votel | |
| 2006/0174408 | A1 * | 8/2006 | Flannery | 5/430 |
| 2008/0066232 | A1 | 3/2008 | Lin | |
| 2010/0050340 | A1 * | 3/2010 | Nygren et al. | 5/430 |

FOREIGN PATENT DOCUMENTS

EP 1738730 A1 1/2007

OTHER PUBLICATIONS

French Search Report, "Application No. FR 0855418", (Mar. 10, 2009).

European Search Report, "Application No. EP 09251930", (Oct. 6, 2009), The Hague.

* cited by examiner

*Primary Examiner* — Robert G Santos
*Assistant Examiner* — Brittany M Wilson
(74) *Attorney, Agent, or Firm* — Kenneth C. Baran

(57) ABSTRACT

A bed includes at least one barrier element (19, 21) extending along a lateral side of a bed frame. At least one part of this barrier element is laterally tiltable, by being hinged (31, 41) in its lower part, along a horizontal axis substantially parallel to the lateral side of the bed for assisting the patient as he or she is standing up.

16 Claims, 8 Drawing Sheets

BED WITH A LATERAL BARRIER HAVING A TILT FEATURE

This application claims priority under 35 USC §119 to French application (serial number 08 55418) filed on Aug. 5, 2008.

TECHNICAL FIELD

The invention relates to a patient bed equipped with a bed frame consisting of a support frame on which is positioned the bedding and at least one lateral safety barrier laterally arranged along one of the lengthwise sides of the bed frame. The invention more particularly relates to an improvement of the lateral barrier enabling the patient to stand up safely under his or her own power.

BACKGROUND

A patient bed equipped with at least one side barrier preventing the patient from falling is known to the prior art. For example, two lateral barriers are arranged along a common lengthwise side of the bed frame, a lateral barrier known as the head barrier element and a lateral barrier known as the foot barrier element. In the upright position, the two barriers are aligned one along the extension of the other and prevent the patient from falling. However, these two barriers are independently moveable relative to each other so that an exit space can be opened. When the patient's condition permits it, he or she can sit on the edge of the bed next to the head barrier element and stand up by sliding vertically while using at least one of the barriers for support.

When the barrier which the patient is holding during this movement is too close to the edge of the bed, the patient's center of gravity is in front of the support point, which can lead to a loss of balance and a fall.

A system is known in which the end of the barrier of the exit space side is configured as a gate pivot-mounted about a vertical axis. This allows the patient to shift his or her support point outwardly when he or she stands up at the side of the bed. Nevertheless, a disadvantage resides in this system in that it does not permit a controlled offset of the support point compatible with the stability of the bed. If, for example, the patient is overweight and if the patient puts his or her weight on the gate at a point too far out from the bed, the bed could move, causing the patient to lose his or her balance and fall. Furthermore, this gate system makes compliance with the norms defining the width of the exit space difficult. If the gate is too wide, it is necessary to provide enough space in the room for its deployment, and the possibility that the patient could grasp it at a point too far from the edge of the bed increases the risk of the bed tipping. The invention makes it possible to overcome these disadvantages by proposing a barrier system that is at least partially tiltable with a controlled offset compatible with the stability of the bed.

SUMMARY

The invention relates more particularly to a patient bed equipped with a bed frame and at least one lateral safety barrier laterally arranged along a lengthwise side of the bed frame, characterized in that at least a part of this barrier is laterally tiltable along a horizontal axis roughly parallel to the lengthwise side by being hinged in its bottom part, and further characterized in that the barrier comprises suitable stabilization means for keeping the tiltable part in a laterally outwardly deployed position.

In a first possible configuration, such a lateral barrier is hinged in its entirety relative to the horizontal axis.

In another possible configuration, such a lateral barrier comprises a tiltable part hinged relative to a non-tiltable part.

With such a system, the part of the barrier which the patient can grasp in order to get up is offset from the side of the bed at a distance of around 10 to 20 cm, which is sufficient so that the manual support point towards the outside remains in front of the patient (but not too far from the bed) so that the projection of the body's center of gravity remains within a polygon of support created by the feet and projection of the support points on the barriers to the floor.

The invention will be more easily understood and its other advantages will emerge more clearly from the following description of several examples of patient beds conforming to its principle, which is provided solely for illustrative purposes and which refers to the appended drawings, in which.

DETAILED DESCRIPTION

Figure 1:
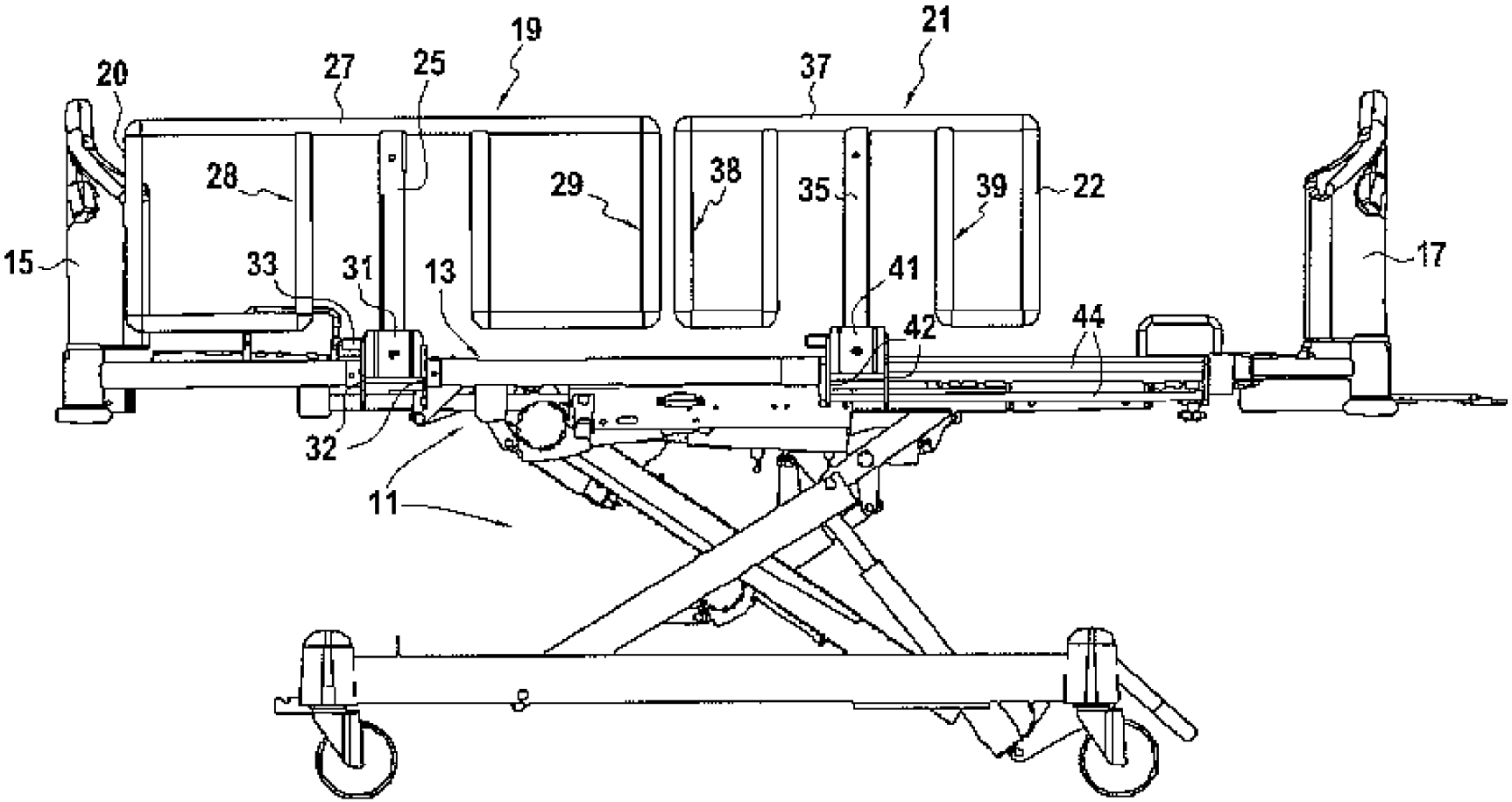
FIG. 1 is an elevation of a first embodiment of a patient bed of the invention, with the lateral barriers raised to prevent the patient from falling.

The patient bed as in FIGS. 1 through 4 consists of a bed frame 11 equipped with a rectangular support frame 13 on which resides a mattress (not shown). The bed frame 11 is equipped with a headboard 15 and a footboard 17, which extend crosswise.

At least one of the lengthwise sides of the support frame 13 is equipped with two lateral barriers 19, 21. One of these is a head barrier element 19, one end of which is adjacent to the headboard, and the other is a foot barrier element 21, which is longitudinally displaceable so that in one of its end positions, one of its ends 22 is adjacent to the footboard 17 (see FIG. 2). The head barrier element 19 comprises an upright 25, on the top of which is attached a horizontal bar 27. The latter is part of two rectangular frames 28, 29 extending towards the bottom on each side of the upright 25. The upright is slide-mounted in a pivotable base plate 31, forming a sliding sheath. Said base plate is mounted along the support frame 13 of the bed. It is hinged to a clevis 32 so that it is capable of pivoting relative to a horizontal axis parallel to the lengthwise direction of the bed. The barrier is capable of assuming at least two stable upper and lower positions by sliding the upright 25 relative to the pivoting base plate. The two flanges of the clevis 32 are fastened to the support frame 13. Furthermore, the base plate is capable of assuming two predetermined stable positions, a raised position (FIG. 1) in which the upright extends vertically on the side of the support frame, and an outwardly tilted position (FIG. 2) in which the bar 27 of the barrier element 19 in the up position is offset by 10 to 20 cm from the lengthwise edge of the support frame. The bar 27 thus constitutes a handhold for the patient wishing to get up. The raised position of the base plate 31 and the upright 25 is stabilized by a blocking/locking system of the base plate. The tilted position can be defined by a simple pivot stop between the base plate 31 and the support frame 13.

Two up and down blocking positions are defined between the upright 25 and the base plate 31. When the barrier is in the up position (FIG. 1), it assures the safety of the patient. When it is in the down position (FIG. 4), it allows the caregiver access to the patient.

The foot barrier element 21 is similar to the head barrier element. It also consists of an upright 35, at the top of which is fastened a horizontal bar 37 forming part of two rectangular frames 38, 39 extending on either side of the upright 35. The latter is slide-mounted in a pivoting base plate 41 hinged to a clevis 42 along a horizontal axis parallel to the lengthwise direction of the bed. Said clevis 42, however, is fastened to a support displaceable along a system integrally forming a slide 44 of the support frame and which enables the displacement of said foot barrier element 21 along said support frame. The displacement of the foot barrier element makes it possible to unblock the necessary and standardized exit space 50 between the two barriers elements.

When the two barriers elements are raised and aligned one along the extension of the other (FIG. 1), they provide effective protection for the patient, preventing any chance of falling.

In contrast, when they are separated from each other (FIG. 2), the foot barrier element being closest to the foot of the bed 17, said exit space 50 is opened to allow the patient to get up under his or her own power by first sitting on the edge of the bed and then standing up. During this phase, the barriers serve as manual support points for the patient.

Figure 2:
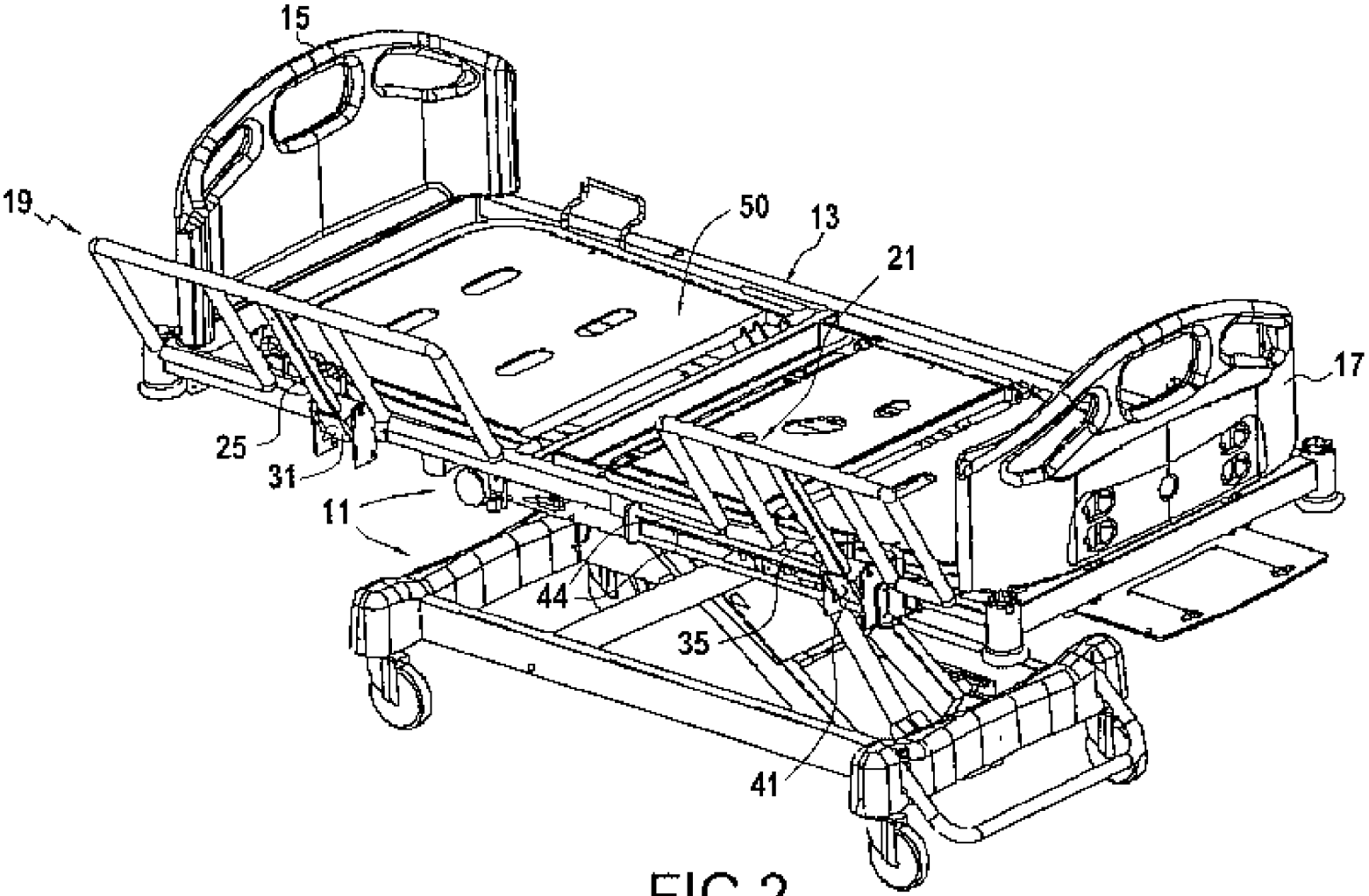
FIG. 2 is a perspective view of the bed, showing the lateral barriers separated and tilted for facilitating the exit of the patient.

According to the invention, when at least one barrier 19, 21 is in the up position but tilted as shown in FIG. 2, the patient is provided with a secure and comfortable support for getting up. This lateral off-setting of the manual support point improves the patient's balance when going from the sitting position to the standing position. By displacing this support point towards the outside, it remains in front of the patient, and the projection of the body's center of gravity remains within a polygon of support delimited by the feet and the projection of the support point or support points to the floor. Obviously, preference is given to both of the barriers 19, 21 being in the up position and tilted as shown in FIG. 2.

Figure 3:
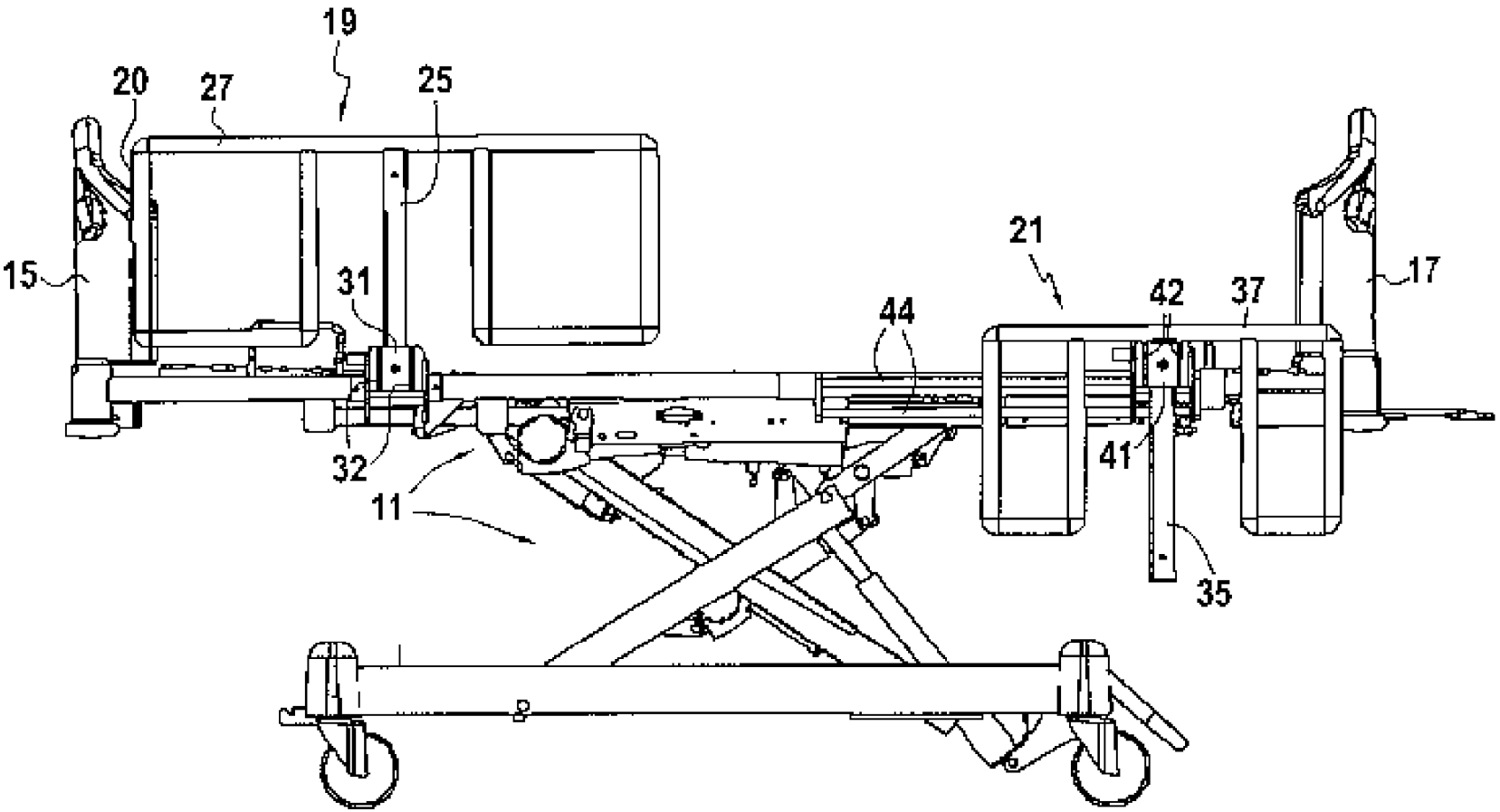
FIG. 3 is an elevation of the same bed, showing another possible positioning of the barriers.
Figure 4:
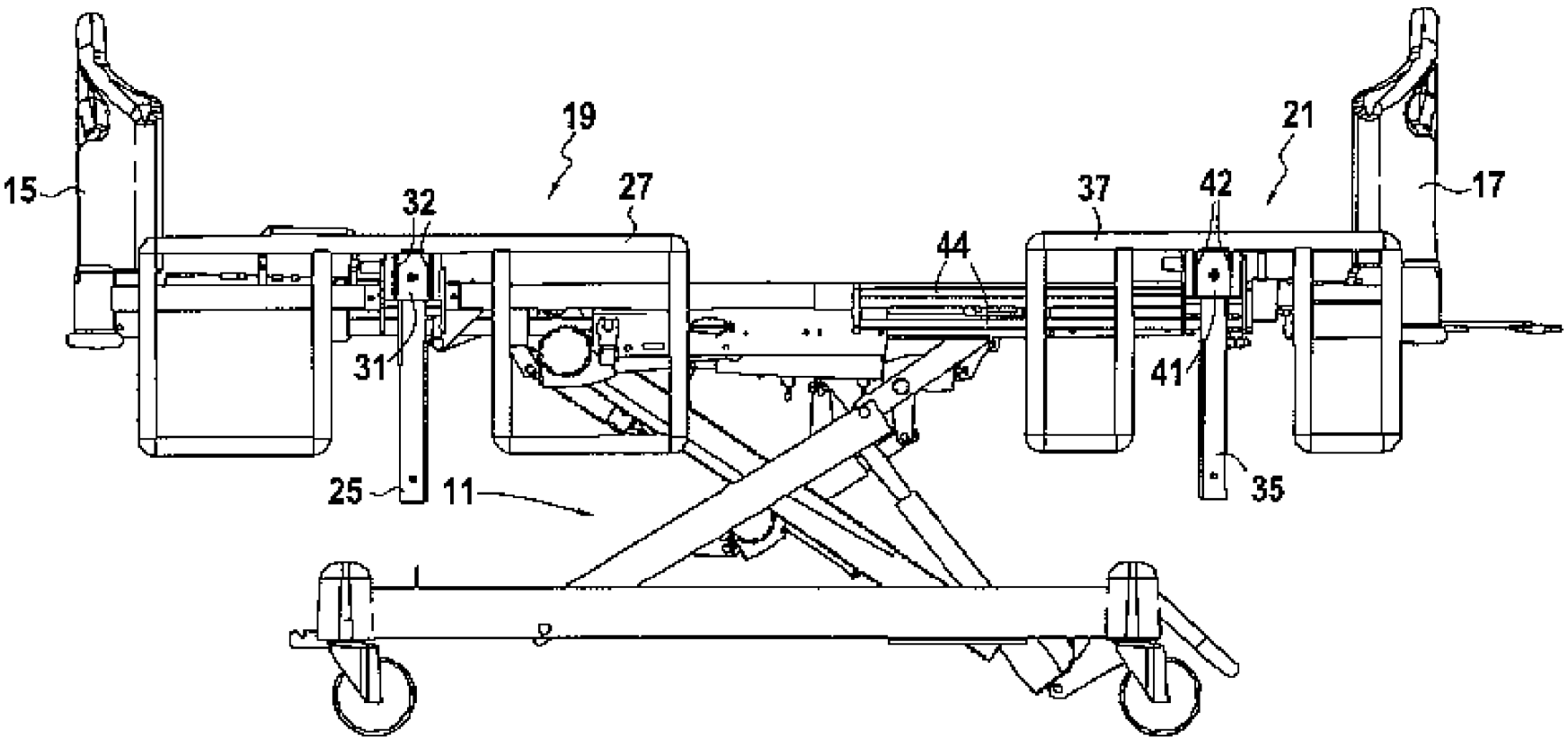
FIG. 4 is a view similar to that of FIG. 3, showing the position of the barriers when it is necessary to have complete access to the patient.
Figure 5:
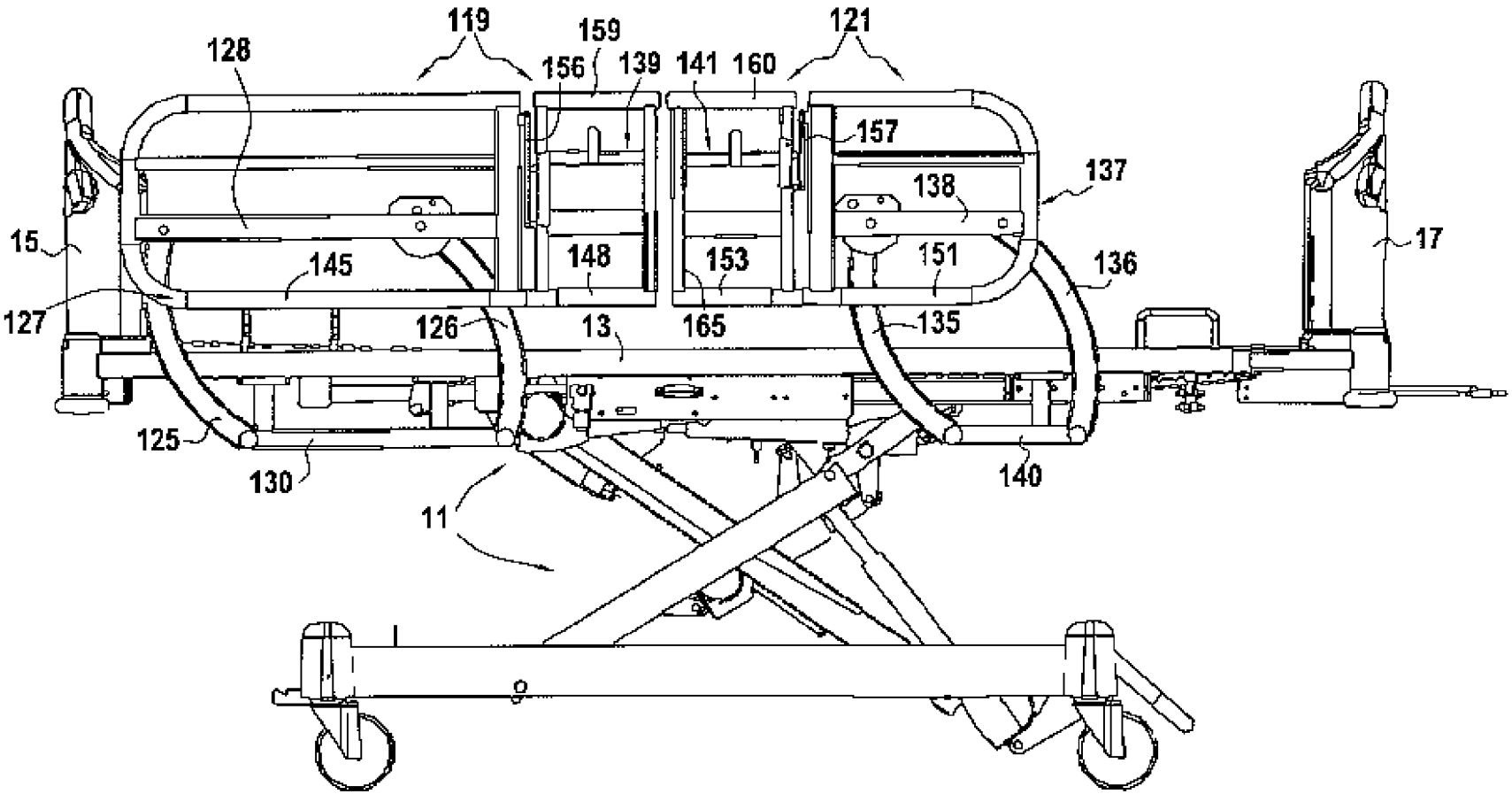
FIG. 5 is an elevation of a second embodiment of a patient bed of the invention.
Figure 6:
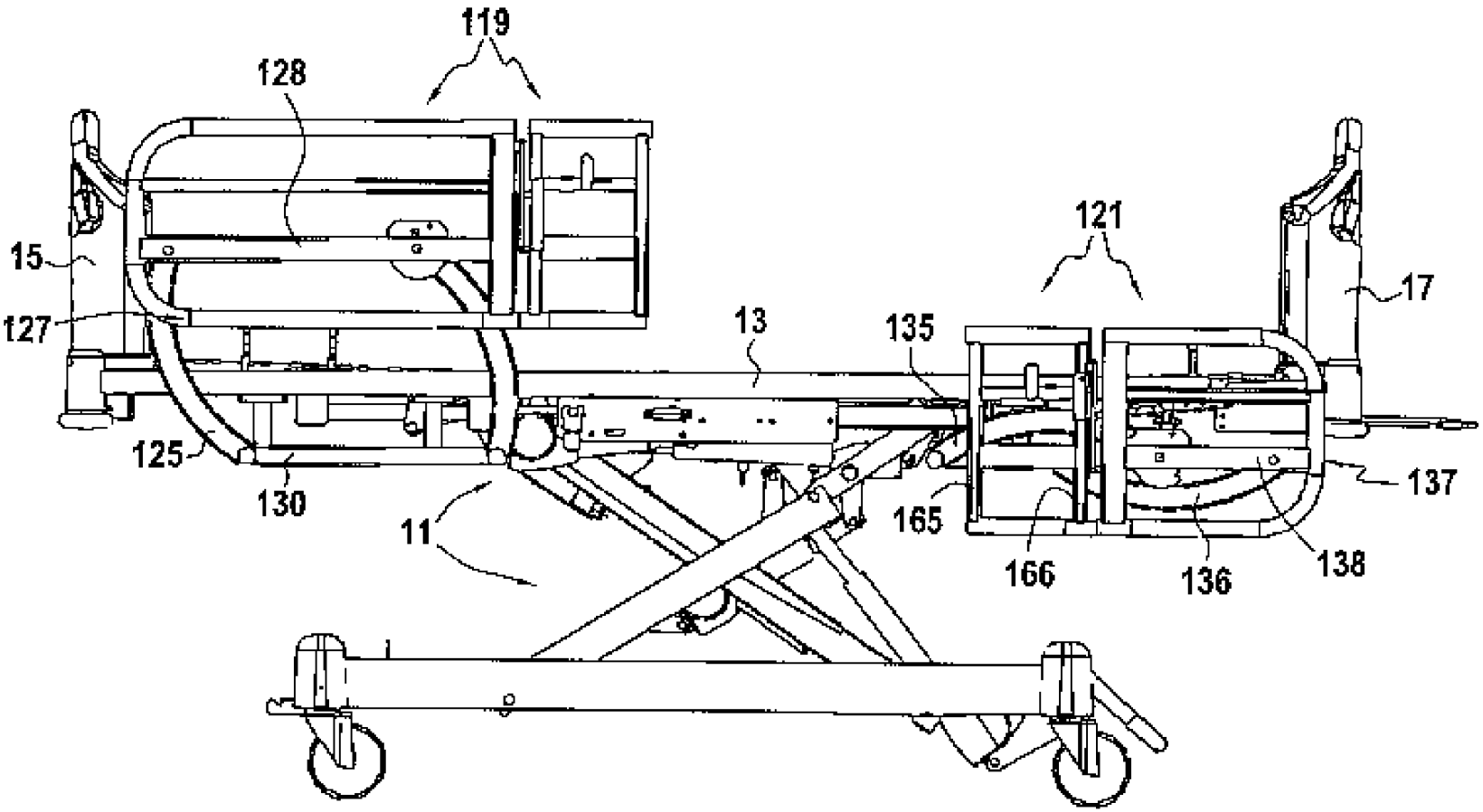
FIG. 6 is an elevation showing another possible positioning of the barriers.
Figure 7:
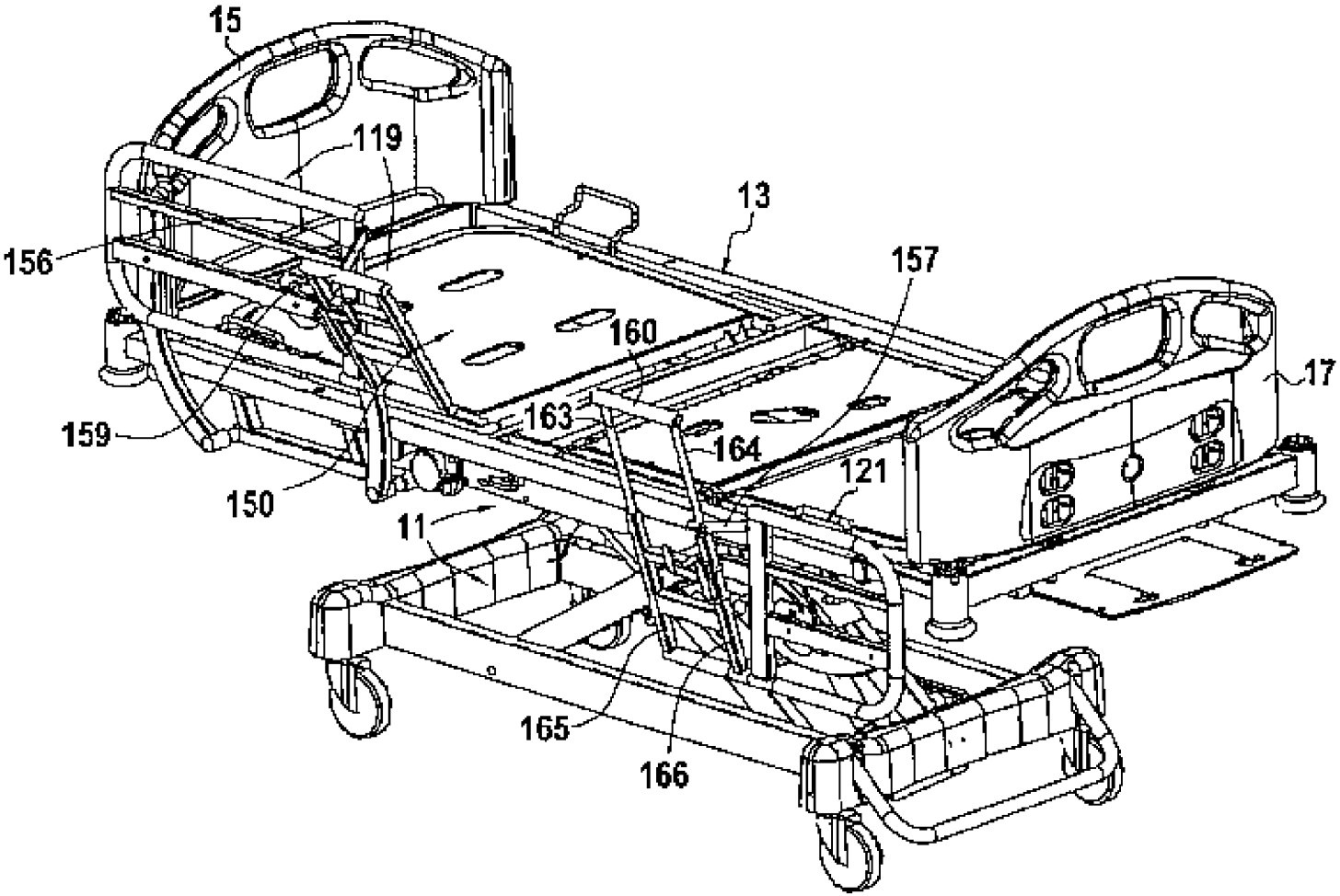
FIG. 7 is a perspective view showing the positions of the barriers for facilitating the exit of the patient.
Figure 8:
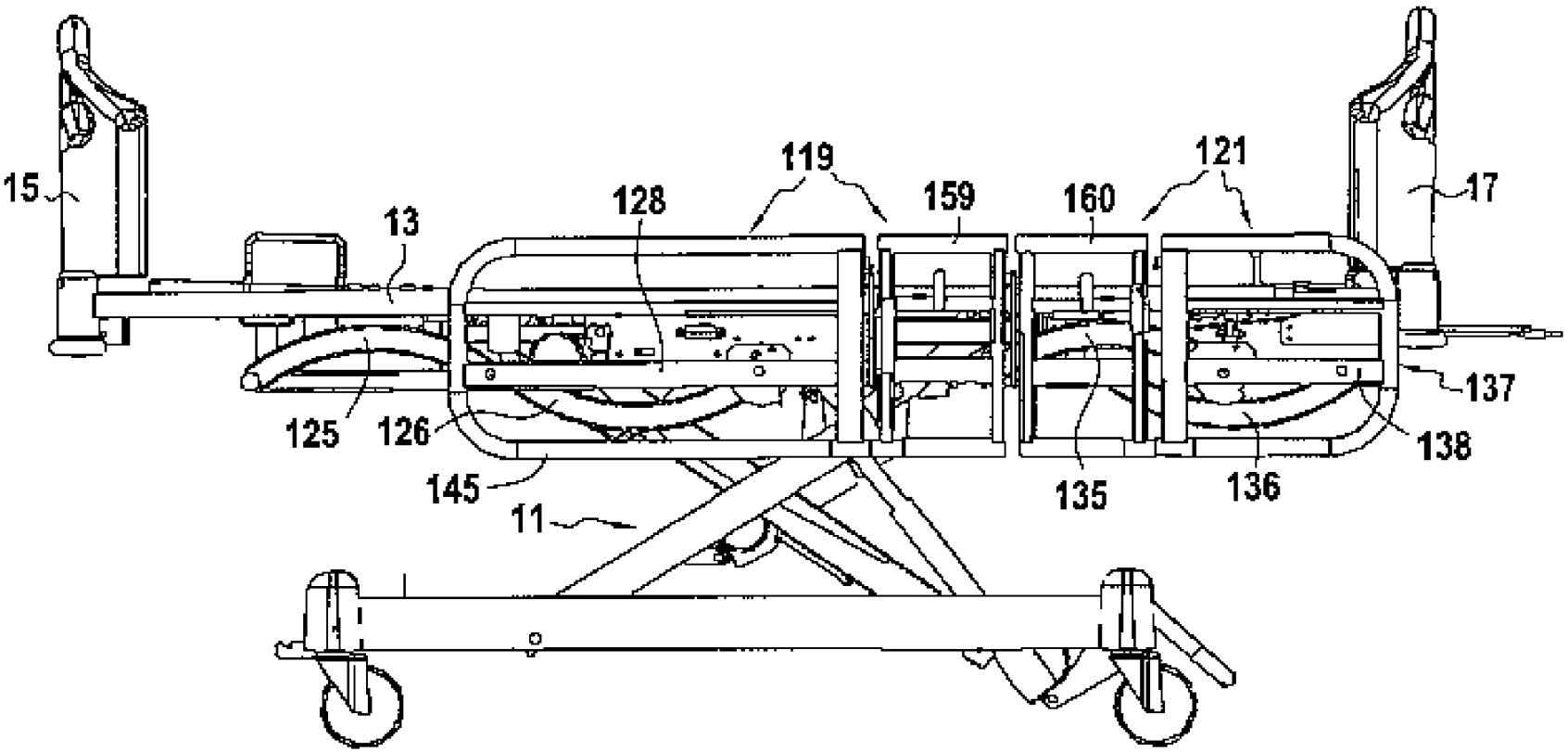
FIG. 8 is an elevation showing the position of the barriers when it is necessary to have complete access to the patient.

Other configurations are possible. In FIG. 3, the head barrier element 19 is raised and the foot barrier element 21 is in the retracted position along the bed. If the patient wishes to get up, he or she has a larger space to pivot and sit on the bed. Once in this position, he or she can stand up by leaning only on the head barrier element, or an assistant can raise the foot barrier element and move the two barrier elements into the tilted position as in FIG. 2.

When the two barrier elements are lowered (FIG. 4), the patient is completely accessible. This configuration in particular permits a gurney to be brought in proximity to the bed, allowing the patient to be transferred while in the reclining position.

The essential elements of the bed are also found in the embodiment of FIGS. 5 through 8, namely the bed frame 11, its support frame 13, the headboard 15, the footboard 17, a lateral head barrier element 119 and a lateral foot barrier element 121. The two barrier elements are of a known type. Each barrier element 119, 121 is displaceable between an up position and a down position by rotation-translation roughly in its own plane, thanks to a deformable parallelogram mechanism.

More precisely, the head barrier element 119 is linked to the bed frame 11 by two hinged arms 125, 126. The barrier consists of a main frame 127 equipped with a horizontal cross member 128 to which the two upper ends of the two arms 125, 126 are hinged. The lower ends of said arms are hinged to a cross member 130 of the bed frame, which is disposed below the support frame 13.

In an analogous manner, the foot barrier element 121 is linked to the bed frame by two hinged arms 135, 136. It consists of a main frame 137 equipped with a horizontal cross member 138 to which the two upper ends of the two arms 135, 136 are hinged. The lower ends of these arms are hinged to a cross member 140 of the bed frame disposed below the support frame 13. Typically, the barrier elements can be moved into the up position (FIG. 5) for complete protection of the patient. They can also be moved into the retracted, down position (FIG. 8) in order to care for or transfer the patient.

According to the invention, at least one barrier element 119, 121 comprises a laterally tiltable part 139, 141 pivot-mounted about a lower horizontal axis of the main frame 127, 137, respectively.

According to the example, each of the barrier elements comprises such a tiltable part. These two parts are adjacent when the two barrier elements are raised and aligned one along the extension of the other (see FIG. 5).

More precisely, the main frame 127 of the head barrier element 119 comprises a horizontal tubular element 145 which forms the pivot axis of the tiltable part 139 of which a bottom side 148 comprises an extension rotatably engaged and mounted in a tubular element 145. The latter forms a type of support bearing for the tiltable part 139.

In an analogous manner, the main frame 137 of the foot barrier element comprises a horizontal tubular element 151 which forms the pivot axis of the tiltable part 141. A bottom side 153 of the latter comprises an extension rotatably mounted in the tubular element 151.

The deployed position of the tiltable part 139, 141 is stabilized by any suitable blocking means such as, say, a connecting shaft or rod 156, 157 mounted between the edge of the main frame and the adjacent edge of the tiltable part. The upper horizontal bar 159, 160 of each tiltable part constitutes a handhold element allowing the patient to stand up under his or her own power. Furthermore, the upper horizontal bar of at least one of the tiltable parts (in this case the bar 160 of the tiltable part 141 of the foot barrier element) is fastened to the upper ends of two parallel rods 163, 164 capable of sliding in two parallel tubular uprights 165, 166, respectively, of said tiltable part. Therefore, when the head barrier element is raised and when the foot barrier element is lowered, an exit space 150 (FIG. 7) is created; however, the handhold element of the foot barrier element can be raised in order to position it roughly at the same level as that of the handhold element of the head barrier element. The predetermined angle of inclination of the tiltable part of the foot barrier element is less than that of the tiltable part of the head barrier element so that the two bars 159, 160 forming the handhold elements are offset roughly at the same distance from the edge of the bed.

We claim:

1. A bed having a frame and at least one lateral barrier element extending longitudinally along a lateral side of the frame, the barrier element comprising a first portion which can serve as a barrier section and which is non-tiltable relative to the frame about a longitudinally extending axis and a second portion which can also serve as a barrier section and which is hinged in its bottom part to render the second portion tiltable about the longitudinal axis relative to the non-tiltable portion to a stabilized, laterally outwardly deployed orientation.

2. The bed of claim 1, wherein the lateral barrier element is slide-mounted along the lateral side.

3. The bed of claim 1 wherein the barrier element includes an upright slide-mounted in a base plate pivotably connected to a clevis mounted on the bed frame.

4. The bed of claim 3 wherein the clevis is displaceable along a system integrally forming a slide of the bed frame.

5. The bed of claim 1 wherein each barrier element comprises a main frame to which are hinged two arms themselves hinged to the bed frame to form a deformable parallelogram mechanism, the barrier element also including a laterally tiltable part pivot-mounted about a lower horizontal axis of the barrier element main frame.

6. The bed of claim 1 wherein an upper horizontal bar of the tiltable part constitutes a handhold.

7. The bed of claim 6 wherein the upper horizontal bar is fastened to rods capable of sliding relative to corresponding uprights of the tiltable part.

8. A bed having a frame and at least one lateral barrier element including an upright slide-mounted in a base plate pivotably connected to a clevis mounted on the frame, the barrier element extending longitudinally along a lateral side of the frame, at least a part of the barrier element being hinged in its bottom part to render the barrier element tiltable about an axis to a stabilized, laterally outwardly deployed orientation, the axis being substantially parallel to the lateral side.

9. The bed of claim 8 wherein the clevis is longitudinally displaceable along a system integrally forming a slide of the bed frame.

10. The bed of claim 8 wherein each barrier element comprises a main frame to which are hinged two arms themselves hinged to the bed frame to form a deformable parallelogram mechanism, the barrier element also including a laterally tiltable part pivot-mounted about a lower horizontal axis of the barrier element main frame.

11. The bed of claim 8 wherein an upper horizontal bar of the tiltable part constitutes a handhold.

12. The bed of claim 11 wherein the upper horizontal bar is fastened to rods capable of sliding relative to corresponding uprights of the tiltable part.

13. A bed having a frame and at least one lateral barrier element extending longitudinally along a lateral side of the frame, each barrier element comprising a main frame to which are hinged two arms themselves hinged to the bed frame to form a deformable parallelogram mechanism, at least a part of the barrier element being hinged in its bottom part to render at least part of the barrier element laterally tiltable about a lower horizontal axis of the barrier element main frame to a stabilized, laterally outwardly deployed orientation, the axis being substantially parallel to the lateral side.

14. The bed of claim 13 wherein the barrier element comprises a tiltable part hinged relative to a non-tiltable part.

15. The bed of claim 13 or 14 wherein an upper horizontal bar of the tiltable part constitutes a handhold.

16. The bed of claim 15 wherein the upper horizontal bar is fastened to rods capable of sliding relative to corresponding uprights of the tiltable part.

* * * * *